US011203197B2

(12) United States Patent
Mueller et al.

(10) Patent No.: US 11,203,197 B2
(45) Date of Patent: Dec. 21, 2021

(54) PNEUMATICALLY CLAMPING ADAPTER SLEEVE

(71) Applicant: Flint Group Germany GmbH, Stuttgart (DE)

(72) Inventors: Uwe Mueller, Ahaus (DE); Markus Schlapschi, Legden (DE)

(73) Assignee: Flint Group Germany GmbH, Stuttgart (DE)

( * ) Notice: Subject to any disclaimer, the term of this patent is extended or adjusted under 35 U.S.C. 154(b) by 0 days.

(21) Appl. No.: 16/768,719

(22) PCT Filed: Dec. 13, 2018

(86) PCT No.: PCT/EP2018/084773
§ 371 (c)(1),
(2) Date: Jun. 1, 2020

(87) PCT Pub. No.: WO2019/115699
PCT Pub. Date: Jun. 20, 2019

(65) Prior Publication Data

US 2021/0170743 A1 Jun. 10, 2021

(30) Foreign Application Priority Data

Dec. 13, 2017 (EP) ..... 17206947

(51) Int. Cl.
*B41F 27/14* (2006.01)
*B41F 27/12* (2006.01)
*B41F 27/10* (2006.01)

(52) U.S. Cl.
CPC ..... *B41F 27/105* (2013.01); *B41F 27/14* (2013.01)

(58) Field of Classification Search
CPC ..... B41F 27/14; B41F 27/10; B41F 27/105; B41P 2227/20; B41P 2227/21
(Continued)

(56) References Cited

U.S. PATENT DOCUMENTS 5,819,657 A * 10/1998 Rossini ..... B41F 13/10 101/376
2003/0177925 A1 9/2003 Lorig et al.
2004/0079250 A1 4/2004 Lorig et al.

FOREIGN PATENT DOCUMENTS

EP 1144200 A1 10/2001
EP 1263592 A2 12/2002
(Continued)

OTHER PUBLICATIONS

International Search Report for PCT/EP2018/084773 dated Jan. 18, 2019.
(Continued)

*Primary Examiner* — Leslie J Evanisko
(74) *Attorney, Agent, or Firm* — Faegre Drinker Biddle & Reath LLP

(57) ABSTRACT

Described herein is an adapter sleeve for adapting the internal diameter of cylindrical hollow cylinders to the external diameter of a cylindrical roller, comprising a sleeve body with (as viewed from the inside to the outside) a deformable base sleeve, optionally an intermediate layer and a top layer. The adapter sleeve furthermore contains a first gas distribution system and a second gas distribution system, which are connected to a gas inlet. The first gas distribution system is connected to at least one first gas outlet, which opens on an outer lateral surface of the adapter sleeve. The second gas distribution system has a cavity, which is designed, when supplied with a pressurized gas, to transmit pressure from the inside to the deformable base sleeve in such a way that the internal diameter of the sleeve body is reduced, at least in a partial region of the adapter sleeve, by a deformation of the base sleeve.

15 Claims, 3 Drawing Sheets

(58) Field of Classification Search
USPC ..... 101/378, 382.1, 375
See application file for complete search history.

(56) References Cited

FOREIGN PATENT DOCUMENTS

| | | | |
|---|---|---|---|
| EP | 1346846 | A2 | 9/2003 |
| EP | 2051856 | A2 | 4/2009 |
| EP | 2532523 | A2 | 12/2012 |
| WO | WO-0032409 | A1 | 6/2000 |
| WO | WO-0044562 | A1 | 8/2000 |
| WO | WO-0170505 | A2 | 9/2001 |
| WO | WO-0207978 | A1 | 1/2002 |
| WO | WO-2007133517 | A2 | 11/2007 |
| WO | WO-2010096133 | A1 | 8/2010 |
| WO | WO-2016135552 | A1 | 9/2016 |

OTHER PUBLICATIONS

Written Opinion of the International Searching Authority for PCT/EP2018/084773 dated Jan. 18, 2019.

* cited by examiner

PNEUMATICALLY CLAMPING ADAPTER SLEEVE

CROSS-REFERENCE TO RELATED APPLICATIONS

This application is a national stage application (under 35 U.S.C. § 371) of PCT/EP2018/084773, filed Dec. 13, 2018, which claims benefit of European Application No. 17206947.8, filed Dec. 13, 2017, both of which are incorporated herein by reference in their entirety.

The invention relates to an adapter sleeve for adapting the internal diameter of cylindrical hollow cylinders to the external diameter of a cylindrical roller, comprising a sleeve body with (as viewed from the inside to the outside) a deformable base sleeve, optionally an intermediate layer and a top layer. The invention furthermore relates to arrangements comprising an adapter sleeve of this kind and methods for mounting a hollow cylinder on a cylindrical roller using an adapter sleeve of this kind.

PRIOR ART

In the printing industry, sleeves and adapter sleeves are used to a large extent in the flexographic printing process. In flexographic printing, ink is transferred to a print medium via a printing form by compressive stress. With relief and intaglio printing, it is one of the most important printing processes, especially in the packaging industry. It is distinguished by its flexible printing form and can therefore be used for printing paper, films and fibrous materials. Moreover, it can be used for various ink systems, ensuring more universal application.

The various embodiments of flexographic printing machines are adapted specifically to the respective area of application. In this context, they can be divided into the main groups of multi-cylinder and central cylinder printing machines. By using steel cylinders with a very wide variety of diameters, it is possible to achieve specific printing repeats. In principle, adapter sleeves for bridging repeats are mounted on a steel cylinder. A sleeve is mounted on the adapter sleeve. In the so-called preassembly process, a printing form or, alternatively, a cliché is mounted on the sleeve. This cliché can be mounted on the sleeve in the form of a printing plate or in the form of an "in the round sleeve" (ITR) with an endless printing pattern.

It is furthermore customary in the printing industry to use a structure consisting of a drive cylinder, characterized by a driven steel or CFRP cylinder (carbon fiber reinforced plastic cylinder), referred to below as a "cylinder", on which in general there is mounted an adapter sleeve and, on the latter, a hollow cylinder, also referred to below as a sleeve, with the printing plates mounted thereon. In order to allow easy mounting, the drive cylinder and the adapter sleeve are provided with gas channels and gas outlets which produce gas cushions between the cylinder and the adapter sleeve and between the adapter sleeve and the hollow cylinder, ensuring easy sliding on. These gas cushions can be produced either conventionally by means of simple openings or, with significant optimization, by means of porous regions of the kind which are implemented in the commercially available rotec® EcoBridge adapter sleeves. Of course, both versions have to be connected to the gas conveying systems of the adapter sleeve.

In general, there are two possibilities for feeding gas to the adapter sleeve: through a drive cylinder gas channel internal to the system or through a separate connection for an external gas supply on the adapter sleeve. In both cases, there is generally a gas channel or gas distribution system, which is milled into the intermediate layer as described in EP 2051856. In the case where gas is fed into the adapter sleeve from the cylinder, the decisive factor is how well this transfer works since, in this case, there are no pneumatic connections but only radial gas channels running through the adapter sleeve. In general, this transfer is optimized with a so-called recess of the kind described in EP 1263592. This makes it possible for the air channels to use air from a larger area and, above all, it offers the decisive advantage in terms of handling that the inlet openings of the adapter sleeve do not have to lie with perfect accuracy over the outlet openings of the cylinder but only within an area delimited by the recess. If, however, a hollow cylinder now has to be changed, e.g. in a printing machine, then, in the case of a gas feed internal to the system, when the gas supply through the drive cylinder is connected up, a gas cushion is also produced between the cylinder and the adapter sleeve simultaneously with the gas cushion, desired for the mounting process, between the adapter sleeve and the sleeve, and it is difficult to remove the hollow cylinder but not the adapter sleeve. If a hollow cylinder has to be changed in the case of a gas supply that can be connected up externally, the clamping of the adapter sleeve on the cylinder is unaffected by this, and a gas cushion is formed only between the adapter sleeve and the sleeve. In order now to reduce slipping of the adapter sleeve in the case of gas being conveyed internally, so-called "interlocks" are often used. This is a matter of a notch with a recess into which a metal pin on the surface of the cylinder can be latched and is no longer able to slip out owing to a slight rotation of the adapter sleeve. Clamping is not produced here. This component is described in document WO 00/44562, which describes the lockability of adapter sleeves to prevent "an axial relative motion". Improved versions are described in WO 2016/135552 and U.S. Pat. No. 5,819,657. However, such "interlocks" cannot be used in many types of machine owing to the technical specifications thereof. Even if these specifications allow their use, the management of these systems is nevertheless very complex. This becomes clear especially during the setup process in the printing machine. Owing to the time pressure during this process, there is often damage to the metal pin of the drive cylinder or to the interlock itself. In order to circumvent these disadvantages, the only possibility hitherto is either to secure the gas supply to the adapter sleeve externally or, in the case of internal gas feed on the cylinder, to integrate a second gas circuit with dedicated outlet openings, which serve exclusively for the mounting and removal of the adapter sleeve and, depending on switch position, can build up a gas cushion only between the adapter sleeve and the cylinder. This version is described in EP 2 532 523, for example. A drive cylinder of this kind is significantly more expensive than a cylinder with just a single gas conduit.

There are also solutions in which sleeves or hollow cylinders can be moved on the surface of the drive cylinder or the adapter sleeve when they are supplied with gas from the outside radially through the sleeve from the top layer. A product of this kind is described in WO 2010/096133, for example. However, it does not contain any internal gas conduits or an additional clamping mechanism activated by the gas flowing through to fix an adapter sleeve on the drive cylinder, especially where air flows radially through said sleeve. Here, there is a clamping effect only with the gas flow switched off.

In addition to use in printing machines themselves, preassembly offers a further central area of application for adapter sleeves. In preassembly, sleeves are prepared for printing, i.e. the printing plates are fixed on the sleeve, generally by means of double sided adhesive tape. In order then to be able to mount the corresponding sleeves with an accurate fit in the receiving device of the preassembly unit, suitable adapter sleeves are required. On the one hand, these must exhibit good clamping with the base cylinder of the mounting unit, and must also ensure accurate fitting of the sleeve. Moreover, they should be able to build up both a gas cushion between the adapter sleeve and the cylinder and between the adapter sleeve and the sleeve. Here too, similarly to the described setup process in the printing machine, there is generally no desire to release the adapter sleeve during the sleeve changing process, but this may almost always be the case in the case of internal gas routing without an interlock.

Generally, an adapter sleeve and, on top of the latter, a hollow cylinder with the printing plate mounted thereon are used on a central cylinder. In order to allow easy mounting, the central cylinder and the adapter sleeve are provided with gas channels and gas outlets which produce gas cushions between the cylinder and the adapter sleeve and between the adapter sleeve and the hollow cylinder, ensuring easy sliding on. If a hollow cylinder then has to be changed, however, gas cushions are once again produced in both intermediate spaces and it is difficult to remove only the hollow cylinder but not the adapter sleeve. One object of the invention may be regarded as providing an adapter sleeve which can be mounted and demounted easily and which still clamps even when supplied with gas and allows only the hollow cylinder or sleeve to be removed.

DISCLOSURE OF THE INVENTION

The proposal is for an adapter sleeve for adapting the internal diameter of cylindrical hollow cylinders to the external diameter of a cylindrical roller, comprising a sleeve body with (as viewed from the inside to the outside) a deformable base sleeve, optionally at least one intermediate layer and a top layer, wherein the adapter sleeve has at least one gas inlet, which is connected to a first gas distribution system, and wherein the adapter sleeve has at least one first gas outlet, which is connected to the first gas distribution system and opens on an outer lateral surface of the adapter sleeve. The adapter sleeve furthermore comprises a second gas distribution system, wherein the second gas distribution system is connected to the gas inlet, and the second gas distribution system has a cavity, which is designed, when supplied with a pressurized gas, to transmit pressure from the inside to the deformable base sleeve in such a way that the internal diameter of the sleeve body is reduced, at least in a partial region of the adapter sleeve, by a deformation of the base sleeve.

The adapter sleeve has a sleeve body which corresponds substantially to those of the adapter sleeves known from the prior art. The sleeve body has a tubular shape or a shape of a hollow circular cylinder and preferably comprises (as viewed from the inside to the outside) a deformable base sleeve, and optionally an intermediate layer and a top layer. The base sleeve, the optional intermediate layer and the top layer, in particular, correspond substantially to those of the adapter sleeves in the prior art.

The deformable base sleeve can be constructed from one or more layers, preferably consisting of one layer. The deformable base sleeve can be composed of a flexible ceramic layer, metal layer, e.g. made of aluminum, nickel and comparable alloys, or of a reinforced or unreinforced plastic or combination thereof. If metals, alloys and ceramics are used, these are preferably in the form of a partial layer, in particular in the form of a perforated plate, a wire mesh or combinations of several of these materials. Reinforced plastics reinforced with fibers, fillers or combinations thereof are preferably used. Suitable fibers are, in particular, metal, glass and/or carbon fibers, but it is also possible to use synthetic fibers. Fillers can be incorporated in the form of inorganic or organic particles. Among the inorganic fillers, it is possible to use carbonates, silicates, sulfates or oxides, e.g. calcium carbonate or calcium sulfate, bentonite, titanium dioxide, silicon oxides, quartz or combinations thereof. Reinforcement is preferably performed by means of fibers, particularly preferably by means of glass and/or carbon fibers. These can be used in the form of woven fabrics, nonwovens, various layers of fibers predominantly in parallel or combinations thereof.

Suitable plastics or mixtures of plastics that may be considered are those which have a glass transition temperature above 50° C., preferably above 70° C., particularly preferably above 80° C. In order to make the production of the base sleeve simple, mixtures that can be cured thermally and/or by UV light are preferably used, the fibers being impregnated with said mixtures in such a way that they are embedded in the plastic matrix. Epoxy compounds, unsaturated polyester-styrene mixtures, polyester, polyether and polyurethanes are preferably used as thermally curable mixtures. Epoxy compounds and unsaturated polyester-styrene mixtures are preferably used.

As an optional intermediate layer, use is made both of hard and of deformable materials, which can preferably be deformed and then return to the initial shape, i.e. have a reset capacity. For this purpose, various polymers, such as natural and synthetic rubbers, elastomers and foams, can be used. The foams can have open or closed cells or combinations thereof. Closed cells are preferably used. The foams are preferably produced from polymers, e.g. polyethylene, polypropylene, polystyrene, polyesters and polyurethanes. A polyurethane foam is preferably used as a foam.

Hard materials, preferably metals, alloys, ceramics, glasses, polymers, e.g. polyether, polyester, polyurethanes, epoxy compounds and, in general, fiber-reinforced or foamed plastics and combinations thereof are used for the top layer. The surface of the top layer can be of rough or smooth configuration, preferably being as smooth as possible, in order to allow hollow cylinders to slide on easily. The top layer is preferably dimensionally stable or hard.

In this case, the materials of the layers are preferably chosen so that they are so impermeable to gases that a pressure buildup is possible and the pressure can be maintained over a period of several days or hours. In some cases, it may also be necessary to make the layers electrically conductive (see, for example, EP 1346846 A1, EP 1144200 A1, EP 2051856 A1 and EP 1263592 A1) in order to avoid electrostatic charging.

The thickness of the base layer is in a range of from 0.3 mm to 8 mm, preferably in a range of from 0.5 mm to 5 mm, particularly preferably in a range of from 2.9 mm to 4.5 mm. The thickness of the optional intermediate layer is in a range of from 0.2 mm to 125 mm, preferably in a range of from 10 mm to 100 mm. The thickness of the top layer is in a range of from 0.5 mm to 10 mm, preferably in a range of from 1 mm to 3 mm. The wall thickness of the adapter sleeve is in a range of from 8 mm to 150 mm, preferably in a range of from 15 to 75 mm. Here, the wall thickness of the adapter sleeve is the sum of the wall thicknesses of all the layers of the adapter sleeve.

The internal diameter of the adapter sleeve according to the invention is in a range of from 10 mm to 1000 mm, preferably in a range of from 40 mm to 630 mm, particularly preferably in a range of from 85 mm to 275 mm. The external diameter of the adapter sleeve according to the invention is in a range of from 20 mm to 2000 mm, preferably in a range of from 100 mm to 700 mm, particularly preferably in a range of from 125 mm to 300 mm.

The adapter sleeve according to the invention has at least one gas inlet, which is connected to a first gas distribution system.

In the adapter sleeve according to the invention, the gas inlet or gas inlets are connected to a first gas distribution system, which distributes the gas in the adapter sleeve. The first gas distribution system can consist of channels or hoses which extend in or between the base layer and the top layer, in one or more intermediate layers, between different layers or combinations thereof. The first gas distribution system is preferably embodied in the form of one or more channels which are introduced into the surface or into the core of a layer, e.g. by drilling, milling, engraving, machining, cutting or combinations thereof. In the adapter sleeve according to the invention, the first gas distribution system is connected to a first gas outlet, which opens on an outer lateral surface and hence on the surface of the top layer. In this case, the first gas outlet can be in the form of one or more round, slotted or angular openings in the top layer or can be designed as a porous material or as a material with a high proportion of openings. Here, the first gas outlet is preferably situated in the first third of one side of the adapter sleeve, as viewed in the longitudinal direction of the adapter sleeve, and this side is preferably the side facing an operator.

The adapter sleeve according to the invention furthermore comprises a second gas distribution system, wherein the second gas distribution system is connected to the gas inlet, and the second gas distribution system has a cavity, which is designed, when supplied with a pressurized gas, to transmit pressure from the inside to the deformable base sleeve in such a way that the internal diameter of the sleeve body is reduced, at least in a partial region of the adapter sleeve, by a deformation of the base sleeve. The second gas distribution system can consist of channels or hoses which extend in or between the base layer and the top layer, in one or more intermediate layers, between different layers or combinations thereof. The second gas distribution system is preferably embodied in the form of one or more channels which are introduced into the surface or into the core of a layer, e.g. by drilling, milling, engraving, machining, cutting or combinations thereof. In this case, the cavity can be configured in such a way that it represents part of the gas distribution system or, alternatively, is in the form of one or more additional cavities. The additional cavity can be arranged in or between the base layer and the top layer, in one or more intermediate layers, between different layers or combinations thereof. It is preferably situated in the vicinity of the base layer. The additional cavity can be produced by drilling, milling, engraving, machining, cutting or combinations thereof, for example.

In one embodiment of the adapter sleeve, a gas connection is arranged as a gas inlet at one end of the adapter sleeve. In this case, the adapter sleeve is supplied with gas in such a way that sliding onto a cylinder which does not make available a gas to form a gas cushion is also possible. Here, the gas connection can be in the form of a quick-action coupling, a gas hose connection, a tube, a tube in combination with a hose with a clamp. The gas connection is preferably a quick-action coupling.

The adapter sleeve preferably comprises a third gas distribution system, which is connected to the gas inlet, and the adapter sleeve furthermore has at least one second gas outlet, which is connected to the third gas distribution system and opens on an inner lateral surface of the adapter sleeve on the surface of the deformable base sleeve.

The third gas distribution system can consist of channels or hoses which extend in or between the base layer and the top layer, in one or more intermediate layers, between different layers or combinations thereof. The third gas distribution system is preferably embodied in the form of one or more channels which are introduced into the surface or into the core of a layer, e.g. by drilling, milling, engraving, machining, cutting or combinations thereof.

Here, the at least one second gas outlet can be in the form of one or more round, slotted or angular openings in the base layer of the base sleeve. For the arrangement, number and configuration of the openings of the second gas outlet, the statements and descriptions made above in relation to the first gas outlet apply.

In another embodiment of the adapter sleeve, the at least one gas inlet is arranged on the inner side of the sleeve body and is designed for connection to gas outlets on the outer lateral surface of the cylindrical roller. By means of this arrangement, it is possible for gas which is made available by the cylindrical roller, e.g. a printing form cylinder on which the adapter sleeve is mounted, to reach the surface of the adapter sleeve and to be used for mounting one or more further hollow cylinders.

The gas inlet formed in the base layer of the sleeve body serves to allow into the adapter sleeve gas which is made available by a cylinder onto which the adapter sleeve is to be slid. In this case, the gas inlet can be in the form of one or more round, slotted or angular openings in the top layer or can be designed as a porous material or as a material with a high proportion of openings.

Here, the gas inlet is preferably situated in the first third of one side of the adapter sleeve, as viewed in the longitudinal direction of the adapter sleeve, and this side is preferably the side facing an operator.

The adapter sleeve preferably comprises a gas control unit, which is designed to enable and/or to block the flow of gas from the gas inlet to the first gas distribution system, to the second gas distribution system and/or to the third gas distribution system.

By means of different settings of the gas control unit, it is possible to selectively direct the gas into none, one, two or all three of the gas distribution systems and thus to produce different functions. If the gas is not directed to any of the gas distribution systems, it is possible to slide the adapter sleeve onto a cylinder with its own gas supply. If the gas is directed only to the first gas distribution system, mounting of a further hollow cylinder on the adapter sleeve is possible because the gas passed through produces a gas cushion between the adapter sleeve and a hollow cylinder. If the gas is directed only to the second gas distribution system, the adapter sleeve is clamped firmly on an existing cylinder, e.g. a printing form cylinder. If the gas is directed only to the third gas distribution system, the adapter sleeve can be slid onto a cylinder using the gas cushion thereby produced, in particular onto a cylinder without its own gas supply. If the gas is directed to the first and to the second gas distribution system, a hollow cylinder can be moved on the adapter sleeve by the gas cushion formed without the adapter sleeve being moved since the sleeve is clamped on the cylinder. Directing gas simultaneously into the second and the third gas distribution system is possible but is of no advantage since the effects of clamping and of gas cushion formation disrupt each other or cancel each other out. A similar situation applies to the case where gas is supplied simultaneously to all three distribution systems, except that movement of a hollow cylinder on the adapter sleeve is then still possible.

The gas control unit can consist of one or more components and can either be integrated into the adapter sleeve or arranged outside the adapter sleeve. The gas control unit is preferably arranged within the adapter sleeve.

The gas control unit is preferably selected from the group comprising a two-way cock, a three-way cock, at least one switch, at least one valve, a banjo bolt and combinations of at least two of these units.

The gas control unit is inserted between the gas inlet and the first, second and/or third gas distribution system, for example. It is furthermore possible, for example, for the first gas distribution system to be connected to the gas inlet without inserting a gas control unit in between and for the gas control unit to be arranged in a connection between the first gas distribution system and the second gas distribution system and/or the third gas distribution system.

The components of the gas control unit can be controllered individually or jointly, wherein control can be performed manually or automatically or semi-automatically via a control device. The gas control unit is preferably designed and configured in such a way that control of the gas control unit takes place from outside the adapter sleeve. For example, valves or switches can be switched electronically or manually. In the case of an electronic circuit, this and any energy supply that may be required in the form of batteries or storage batteries can be integrated into the adapter sleeve. Another possibility is wireless communication between the control device and the components of the gas control unit.

The at least one first gas outlet and/or the at least one second gas outlet are/is preferably designed to discharge compressed air in a manner distributed over the length of the adapter sleeve or adjacent to one end of the adapter sleeve.

The first and/or the second gas outlet are/is preferably installed at one end of the adapter sleeve. This ensures that the air cushion produced reaches as far as the ends of a printing form cylinder and that easy mounting of an adapter sleeve on a printing form cylinder or of a printing sleeve on an adapter sleeve is possible. The distance between the first and the second gas outlet from the end of the adapter sleeve is preferably in a range of from 1 mm to 100 mm, particularly preferably in a range of from 5 mm to 50 mm.

The at least one first gas outlet and/or the at least one second gas outlet are/is preferably embodied as circumferentially arranged holes or circumferentially arranged gas-permeable porous regions.

If the gas inlet of the adapter sleeve is arranged on the inner side of the sleeve body, this too can be configured as one or more openings or as one or more gas-permeable porous regions. Examples of this are circumferentially arranged holes or circumferentially arranged gas-permeable porous regions.

In order to make a region porous and gas-permeable, both porous materials and materials with a high proportion of openings per unit area can be used. Such materials can have screen-type, rake-type, slat-type or slotted openings.

Here, the first gas outlet, the second gas outlet and/or the gas inlet can be in the form of one or more round, slotted or angular openings or holes in the top layer and/or in the base layer. However, the openings can also be in the form of porous regions which are introduced into the top layer and/or the base layer and optionally into the intermediate layer and comprise porous materials. Porous materials are interpreted to mean materials in which the pores account for from 1% to 50% of the volume, particularly preferably from 5 to 40% of the volume, and very particularly preferably from 10% to 30% of the volume of the material. Here, the percentage figure relates to the proportion of the volume of the pores in the volume of the whole porous material. The pore size is in a range of from 1 μm to 500 μm, preferably from 2 μm to 300 μm, preferably from 5 μm to 100 μm and very particularly preferably from 10 μm to 50 μm. The pores are preferably distributed uniformly throughout the volume of the porous material. Examples of such materials are foamed materials with open cells or sintered porous materials.

The permeability is determined according to ISO 4022: 1987, for example, wherein the pressure loss after flow through the porous material is measured with a given filter area at a given volume flow and at constant pressure and temperature, and the permeability coefficient $\alpha$ for laminar and $\beta$ for turbulent flow is determined. The porous materials according to the invention preferably have a value of $\alpha$ greater than $0.01*10^{-12}m^2$ and a value of $\beta$ greater than $0.01*10^{-7}m$. As a particular preference, the porous materials preferably have a value of $\alpha$ greater than $0.05*10^{-12}m^2$ and a value of $\beta$ greater than $0.1*10^{-7}m$.

The porous region is preferably divided into one porous region or into several porous regions. In this case, a porous region is preferably configured as a ring running round in the circumferential direction, or a porous region comprises a plurality of subregions, which are configured and arranged in the form of a discontinuous ring running round in the circumferential direction. The width of a ring is preferably in a range of from 1 cm to 20 cm and particularly preferably in a range of from 5 cm to 15 cm. Alternatively or in addition, at least one porous region can be provided in the form of an axially extending strip. The use of porous materials offers the advantages that less gas is consumed and noise pollution is reduced.

A material which has at least one opening for every 500 $mm^2$ of area is regarded as a material with a high proportion of openings. The material with a high proportion of openings preferably has at least one opening for every 200 $mm^2$ of area. In this context, the diameter of the openings is in a range of from 0.1 mm to 2 mm, preferably in a range of from 0.2 mm to 1.5 mm, particularly preferably in a range of from 0.3 mm to 1 mm. The number of openings is greater than 1, preferably greater than 4, and particularly preferably greater than 6. The openings can be distributed regularly or irregularly over the circumference and can be arranged in one or more rows.

On its outer surface, the material with a high proportion of openings has a proportion of openings per unit area in a range of from 0.3% to 90%, for example. The surface preferably has a proportion of openings per unit area of 1% to 90%. Here, a proportion of openings per unit area in a range of from 5% to 80% is particularly preferred, and a proportion of openings per unit area in a range of from 10% to 70% is very particularly preferred. The proportion of openings per unit area is in a range of from 0.3% to 50%, for example. The openings are embodied as continuous or branched openings or channels and are connected to the gas feed. The diameter of the openings or the width of the channels or slots is in a range of from 100 μm to 5 mm, preferably in a range of from 500 μm to 2 mm.

The cavity preferably extends substantially over the length of the adapter sleeve, or the cavity is limited to a region adjoining one of the ends. In this case, the cavity can be configured in such a way that it represents part of the gas distribution system, is in the form of one end of a channel of the gas distribution system or, alternatively, is in the form of one or more additional cavities. The end or ends of the channels of the second gas distribution system or of the additional cavity or cavities can be arranged at one or more desired locations in the adapter sleeve. They can be distributed uniformly or non-uniformly over the length of the adapter sleeve, or can be arranged in one or both first thirds of the adapter sleeve. The ends of the channels or the cavities can be arranged to have a circumferential extent. However, the cavity can also be designed as a circumferential channel, which has the advantage that only one gas feed connection is required. When viewed in the longitudinal direction of the adapter sleeve, the ends of the cavity or cavities are preferably arranged in the first third of the adapter sleeve, which lies opposite the gas inlet. In other words, the ends of the channels or the cavity or cavities are arranged in the first third of the adapter sleeve, on the side facing away from an operator.

Another aspect of the invention relates to an arrangement containing a cylindrical roller and at least one adapter sleeve described above mounted on the roller. In such an arrangement, the cylindrical roller can be any cylindrical roller which can rotate and accept further hollow cylinders. Such arrangements are encountered particularly in printing and in refining or treatment processes. Arrangements according to the invention can be used especially in arrangements for intaglio printing, relief printing and offset printing processes.

Another aspect of the invention relates to an arrangement containing a cylindrical roller, at least one adapter sleeve described above mounted on the roller, and at least one hollow cylinder mounted on the adapter sleeve. In such an arrangement, the cylindrical roller can be any cylindrical roller which can rotate and accept further hollow cylinders, wherein the adapter sleeve is used to adapt the diameters of the cylindrical roller and the hollow cylinder. Such arrangements are encountered particularly in printing and in refining or treatment processes. Arrangements according to the invention can be used especially in arrangements for intaglio printing, relief printing and offset printing processes.

Another aspect of the invention is to provide a method for mounting a hollow cylinder on a cylindrical roller using an adapter sleeve described above. The method comprises the following steps:

a) supplying a cylindrical roller, supplying one of the adapter sleeves described above and supplying a hollow cylinder,
b) positioning the adapter sleeve on the cylindrical roller,
c) supplying the adapter sleeve with a pressurized gas in such a way that the gas enters a cavity in the adapter sleeve, wherein the gas in the cavity transmits pressure to a deformable base sleeve of the adapter sleeve in such a way that the internal diameter of the adapter sleeve is reduced, at least in a partial region of the adapter sleeve, by a deformation of the base sleeve and thereby clamps the adapter sleeve on the cylindrical roller,
d) supplying the adapter sleeve with a pressurized gas in such a way that the gas flows out via a first gas distribution system of the adapter sleeve, via at least one first gas outlet at the outer lateral surface of the adapter, and forms a gas cushion,
e) mounting and positioning the hollow cylinder on the adapter sleeve,
f) switching off the gas supply, wherein an excess pressure in the cavity in the adapter sleeve may optionally be maintained, is contained in a further embodiment.

Another aspect of the invention is to provide a method for demounting a hollow cylinder from a cylindrical roller, wherein the hollow cylinder has been mounted using one of the adapter sleeves described. The method comprises the following steps:

a) supplying an arrangement containing a roller equipped with a gas supply, one of the adapter sleeves described above, and at least one hollow cylinder,
b) supplying the adapter sleeve with a pressurized gas in such a way that the gas enters a cavity in the adapter sleeve, wherein the gas in the cavity transmits pressure to a deformable base sleeve of the adapter sleeve in such a way that the internal diameter of the adapter sleeve is reduced, at least in a partial region of the adapter sleeve, by a deformation of the base sleeve and thereby clamps the adapter sleeve on the cylindrical roller,
c) supplying the adapter sleeve with a gas, with the result that the gas flows out via a first gas distribution system of the adapter sleeve and via at least one first gas outlet at the outer lateral surface of the adapter,
d) removing the hollow cylinder.

In addition, the method for mounting or demounting preferably comprises supplying an adapter sleeve having at least one gas inlet on the inner side of the sleeve body, wherein the cylindrical roller is equipped with a gas distribution system, with the result that the cylindrical roller supplies a gas cushion for the positioning of the adapter sleeve on the cylindrical roller and, after the positioning of the adapter sleeve on the cylindrical roller, the gas for acting upon the adapter sleeve is supplied through the cylindrical roller. This method is used especially when the cylindrical roller has its own gas supply. In this case, no third gas distribution system and no second gas outlet opening are provided in the adapter sleeve according to the invention.

In addition, the method for mounting or demounting preferably comprises supplying an adapter sleeve having at least one gas connection arranged as a gas inlet at the end of the adapter sleeve, wherein, to mount the adapter sleeve on the cylindrical roller, the adapter sleeve is supplied with a gas via the gas connection of the adapter sleeve in such a way that the gas emerges from at least one second gas outlet, which opens at an inner lateral surface of the adapter sleeve and forms a gas cushion which enables the adapter sleeve to be mounted on or demounted from the cylindrical roller. This method is used especially when the cylindrical roller does not have its own gas supply. In this case, a third gas distribution system and a second gas outlet opening are provided in the adapter sleeve according to the invention.

Any gas can be employed as a gas, compressed air preferably being used. In certain circumstances, it may be prudent to use inert gases (e.g. nitrogen, argon, helium or CO2) in order to avoid fire or explosions or in order to prevent or reduce unwanted reactions (e.g. oxidation) of products or components. In most cases, the gases are used under excess pressure in order to be able to produce a corresponding gas cushion, and the pressures vary from 1 bar to 30 bar, preferably 4 to 8 bar, depending on the intended use.

BRIEF DESCRIPTION OF THE FIGURES

In the figures:

FIG. 1 shows a cross section of a first embodiment of an adapter sleeve 10 on a cylindrical roller 100. The adapter sleeve 10 in FIG. 1 has a sleeve body with a deformable base layer 3 and a top layer 5. The shape of the sleeve body corresponds substantially to a hollow circular cylinder 200. An outer lateral surface 30 of the adapter sleeve 10 is formed by the outer side of the top layer 5, and an inner lateral surface 32 of the adapter sleeve 10 is formed by the outer surface of the base layer 3.

Figure 1:
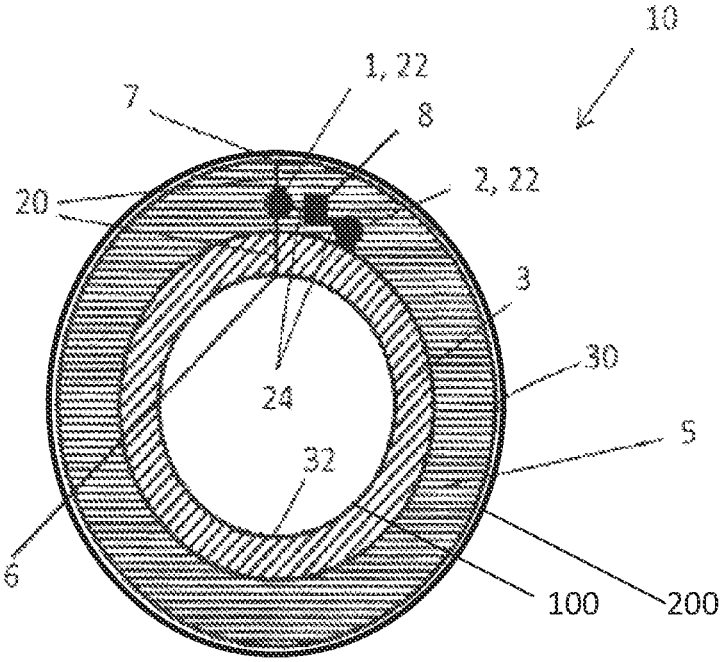
FIG. 1 shows a cross section of the adapter sleeve without the intermediate layer.

The adapter sleeve 10 furthermore comprises a gas inlet 6 arranged on the inside of the sleeve body. In the embodiment illustrated in FIG. 1, the gas inlet 6 is embodied as an opening in the deformable base layer 3, preferably as a radially encircling ring of openings.

A first gas distribution system 1 of the adapter sleeve 10 comprises a plurality of channels 20, 22, which extend in the deformable base layer 3 and/or the top layer 5 or between said layers. A channel 20 extending in the radial direction in the flexible base layer 3 and the top layer 5 connects the gas inlet 6 to the first gas distribution system 1.

Via a channel 20 extending in the radial direction, the gas distribution system 1 is connected to a first gas outlet 7, which opens at the surface of the top layer 5 and hence on the outer side of the adapter sleeve 10. The adapter sleeve 10 has further first gas outlets 7 (not visible in the illustration in FIG. 1), which can be supplied with gas by the first gas distribution system 1 via further channels. Gas flowing out of the first gas outlets 7 can be used to produce an air cushion, which allows a hollow cylinder to be mounted easily on the adapter sleeve 10.

The adapter sleeve 10 furthermore has a second gas distribution system 2, of which only a channel 22 extending in the axial direction is visible in the view in FIG. 1. The second gas distribution system 2 is connected to the first gas distribution system 1 via connecting channels 24 and a gas control unit 8. Starting from the gas inlet 6, gas can be passed via the first gas distribution system 1 and the gas control unit 8 to the second gas distribution system 2. A gas flow to the second gas distribution system 2 can be enabled or blocked by means of the gas control unit 8.

Figure 2:
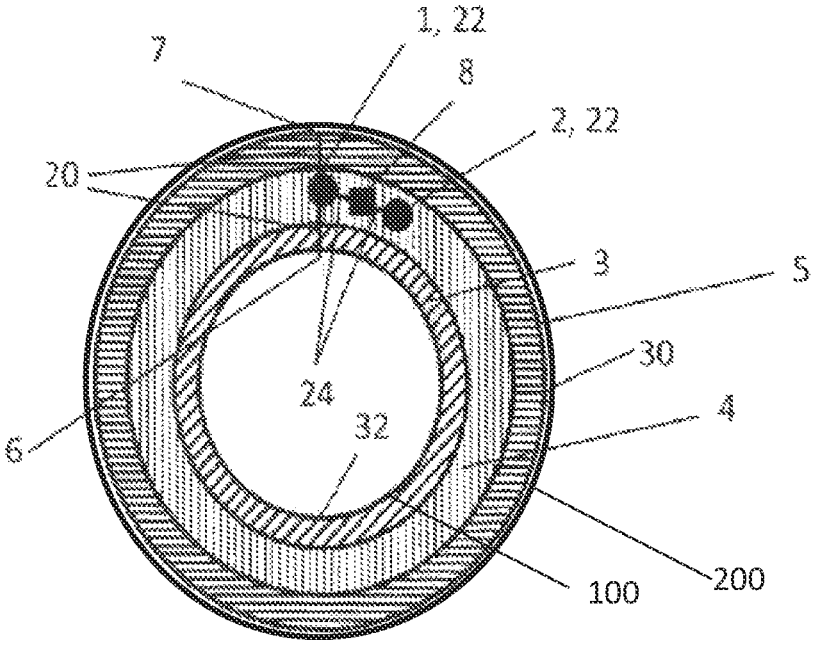
FIG. 2 shows a cross section of the adapter sleeve with the intermediate layer.

FIG. 2 shows a cross section of a second embodiment of an adapter sleeve 10 on a cylindrical roller 100. The adapter sleeve 10 in FIG. 2 has a sleeve body with (as viewed from the inside to the outside) a deformable base layer 3, an intermediate layer 4 and a top layer 5. The shape of the sleeve body corresponds substantially to a hollow circular cylinder 200.

The adapter sleeve 10 furthermore comprises a gas inlet 6 arranged on the inside of the sleeve body. As described with reference to the first embodiment in FIG. 1, the gas inlet 6 is embodied as an opening in the deformable base layer 3, preferably as a radially encircling ring of openings.

A first gas distribution system 1 comprises a plurality of channels 20, 22, which extend in the deformable base layer 3, the intermediate layer 4 and/or the top layer 5 or between the layers. The first gas distribution system 1 is connected to the first gas inlet 6 via a channel 20 extending in the radial direction in the flexible base layer 3 and the intermediate layer 4.

Via a channel 20 extending in the radial direction in the intermediate layer 4 and the top layer 5, the gas distribution system 1 is connected to a first gas outlet 7, which opens at the surface of the top layer 5 and hence on the outer side of the adapter sleeve 10. The adapter sleeve 10 has further first gas outlets 7 (not visible in the illustration in FIG. 2), which can be supplied with gas by the first gas distribution system 1 via further channels.

The adapter sleeve 10 furthermore has a second gas distribution system 2, of which only a channel 22 extending in the axial direction is visible in the view in FIG. 2. The second gas distribution system 2 is connected to the first gas distribution system 1 via connecting channels 24 and a gas control unit 8. Starting from the gas inlet 6, gas can be passed via the first gas distribution system 1 and the gas control unit 8 to the second gas distribution system 2. A gas flow to the second gas distribution system 2 can be enabled or blocked by means of the gas control unit 8.

Figure 3:
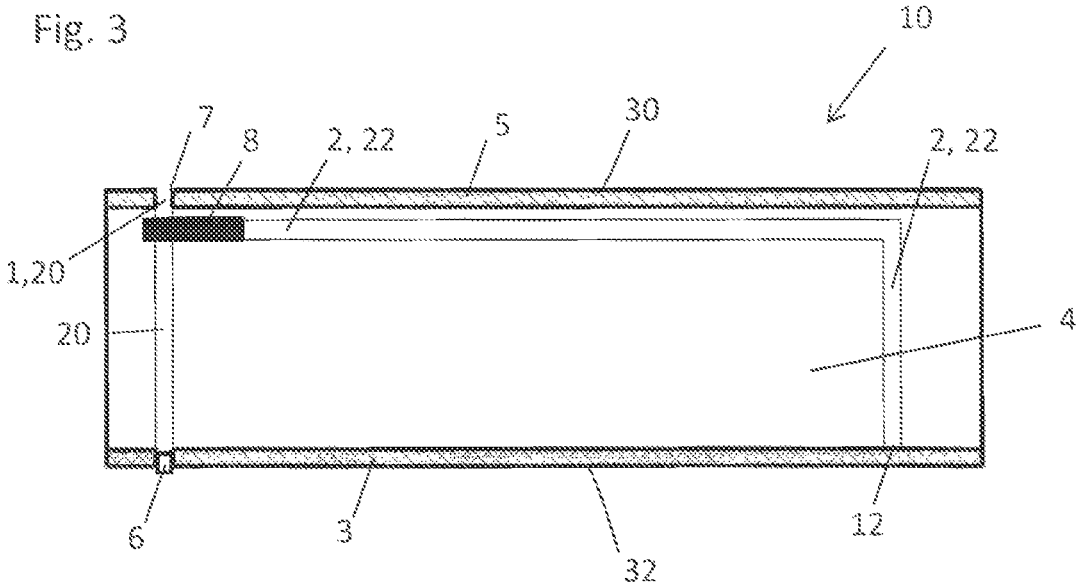
FIG. 3 shows a longitudinal section of the adapter sleeve with the first and second gas distribution systems.

FIG. 3 shows schematically a longitudinal section of the adapter sleeve 10 of the second embodiment.

As already described with reference to FIG. 2, the adapter sleeve 10 has a sleeve body with a deformable base layer 3, an intermediate layer 4 and a top layer 5. The outer lateral surface 30 of the adapter sleeve 10 is formed by the outer side of the top layer 5, and the inner lateral surface 32 of the adapter sleeve 10 is formed by the outer surface of the base layer 3.

The gas inlet 6 is embodied in the form of an opening in the deformable base layer 3, preferably as a radially encircling ring of openings. A channel 20 extending in the radial direction extends in the deformable base layer 3 and the intermediate layer 4 and connects the gas inlet 6 to the first gas distribution system 1.

The first gas distribution system 1 comprises a plurality of channels 20, 22, of which only a channel 20 extending in the radial direction to the first gas outlet 7 is visible in FIG. 3. The adapter sleeve 10 has further first gas outlets 7 (not visible in the illustration in FIG. 3), which can be supplied with gas by the first gas distribution system 1 via further channels and are preferably configured as an encircling ring of openings. Gas flowing out of the first gas outlets 7 can be used to produce an air cushion, which allows a hollow cylinder to be mounted easily on the adapter sleeve 10.

The adapter sleeve 10 furthermore has a second gas distribution system 2. The second gas distribution system 2 is connected to the first gas distribution system 1 via the gas control unit 8 and has a channel 22 extending in the axial direction and a radial channel 20 extending in the radial direction in the direction of the deformable base layer 3.

The radially extending channel 20 of the second gas distribution system 2 forms a cavity 12, which adjoins the deformable base layer 3. If pressurized gas is fed to the second gas distribution system 2 via the gas inlet 6 and the gas control unit 8, pressure can be built up in the cavity 12 by inflowing gas. The pressurized gas in the cavity 12 exerts a force on the deformable base sleeve 3, which brings about a deformation of the base sleeve 3 and hence a reduction in the internal diameter of the adapter sleeve 10. If the adapter sleeve 10 is mounted on a cylinder, the reduction in the internal diameter brings about clamping of the adapter sleeve 10 on the cylinder.

Figure 4:
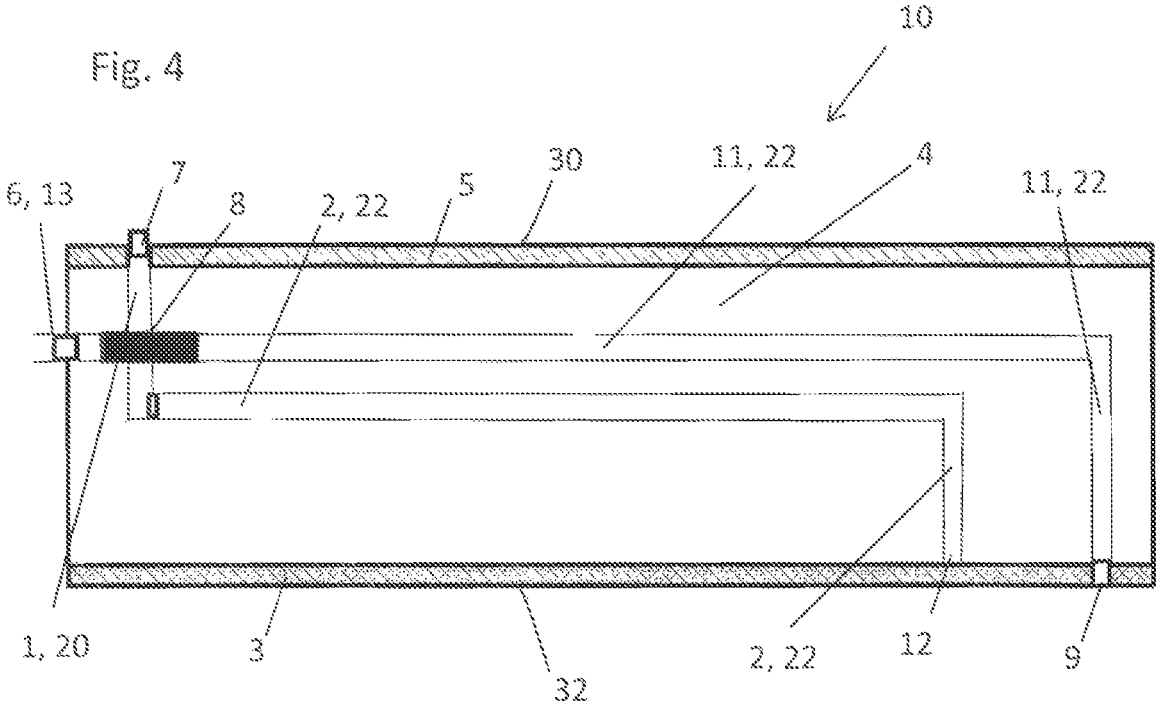
FIG. 4 shows a longitudinal section of the adapter sleeve with the first, second and third gas distribution systems.

FIG. 4 shows schematically a longitudinal section of the adapter sleeve 10 of a third embodiment.

As already described with reference to FIG. 2, the adapter sleeve 10 has a sleeve body with a deformable base layer 3, an intermediate layer 4 and a top layer 5. In contrast to the second embodiment in FIGS. 2 and 3, the adapter sleeve 10 of the third embodiment has a gas connection 13 as a gas inlet 6 at one of the ends. Via the gas connection 13, it is possible to connect a compressed air line to the adapter sleeve 10, for example.

The gas connection 13 is connected to the gas control unit 8. The gas control unit 8 can enable or block a gas flow from the gas connection 13 to the first gas distribution system and to the second gas distribution system 2 as well as to a third gas distribution system 11.

The first gas distribution system 1 comprises a plurality of channels 20, 22, of which only a channel 20 extending in the radial direction to the first gas outlet 7 is visible in FIG. 4. The adapter sleeve 10 has further first gas outlets 7 (not visible in the illustration in FIG. 4), which can be supplied with gas by the first gas distribution system 1 via further channels. Gas flowing out of the first gas outlets 7 can be used to produce an air cushion, which allows a hollow cylinder to be mounted easily on the adapter sleeve 10. By means of the gas control unit 8, the air cushion can be influenced by controllering the gas flow.

The second gas distribution system has a channel 22 extending in the axial direction and a radial channel 20 extending in the radial direction in the direction of the deformable base layer 3. The radially extending channel 20 of the second gas distribution system 2 forms a cavity 12, which adjoins the deformable base layer 3. If pressurized gas is fed to the second gas distribution system 2 via the gas connection 13 and the gas control unit 8, pressure can be built up in the cavity 12 by inflowing gas. The pressurized gas in the cavity 12 exerts a force on the deformable base sleeve 3, which brings about a deformation of the base sleeve 3 and hence a reduction in the internal diameter of the adapter sleeve 10. If the adapter sleeve 10 is mounted on a cylinder, the reduction in the internal diameter brings about clamping of the adapter sleeve 10 on the cylinder.

The adapter sleeve 10 of the third embodiment, which is shown in FIG. 4, has a third gas distribution system 11, of which a channel 22 extending in the axial direction and a channel 20 extending in the radial direction are visible in the illustration in FIG. 4. The radially extending channel 20 connects the third gas distribution system 11 to a second gas outlet 9, which is formed on the inner side of the adapter sleeve 10 as an opening in the deformable base layer 3. The adapter sleeve 10 has further second gas outlets 9, which are not visible in FIG. 4. If a gas is fed to the third gas distribution system 11 by appropriate activation of the gas control unit 8, this is passed to the second gas outlets 9 and flows out there. The gas flowing out at the second gas outlets 9 creates an air cushion on the inner side of the adapter sleeve 10, which enables the adapter sleeve 10 to be mounted easily on a cylinder.

Figure 5:
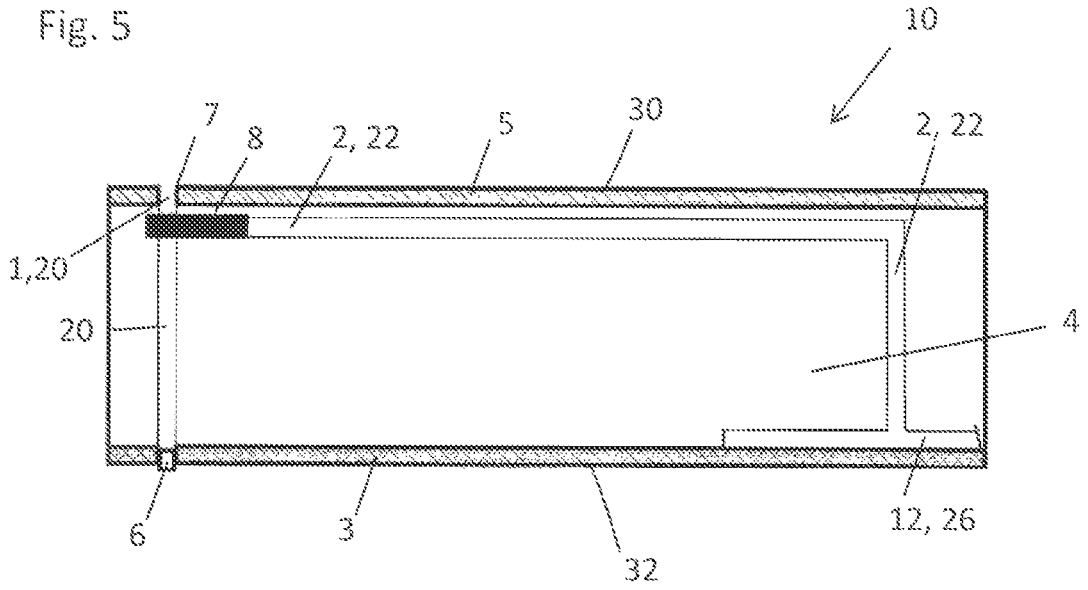
FIG. 5 shows a longitudinal section of the adapter sleeve with the first and second gas distribution systems and with an additional cavity at the end of the second gas distribution system.

FIG. 5 shows schematically a longitudinal section of the adapter sleeve 10 of a fourth embodiment. The adapter sleeve 10 illustrated in FIG. 5 corresponds to the adapter sleeve 10 of the second embodiment, which is described with reference to FIGS. 2 and 3, wherein the cavity 12 is configured as a radially encircling hollowed-out region 26 in the intermediate layer 4 between the deformable base layer 3 and the mouth of a channel 20, extending in the radial direction, of the second gas distribution system 2. The hollowed-out region 26 makes it possible to exert pressure on the deformable base layer 3 over a larger area, thus ensuring that a reduction in the internal diameter of the adapter sleeve 10 takes place over a larger area.

Figure 6:
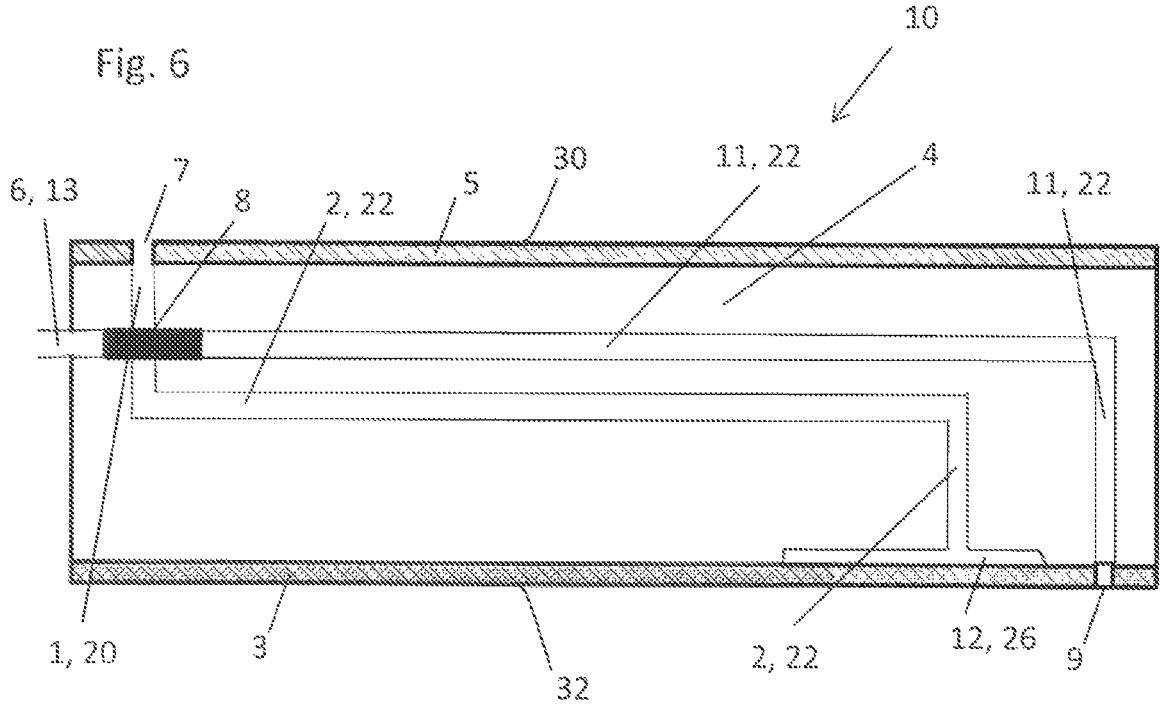
FIG. 6 shows a longitudinal section of the adapter sleeve with the first, second and third gas distribution systems and with an additional cavity at the end of the second gas distribution system

FIG. 6 shows schematically a longitudinal section of the adapter sleeve 10 of a fifth embodiment. The adapter sleeve 10 illustrated in FIG. 6 corresponds to the adapter sleeve 10 of the third embodiment, which is described with reference to FIG. 4, wherein the cavity 12 is configured as a radially encircling hollowed-out region 26 in the intermediate layer 4 between the deformable base layer 3 and the mouth of a channel 20, extending in the radial direction, of the second gas distribution system 2. The hollowed-out region 26 makes it possible to exert pressure on the deformable base layer 3 over a larger area, thus ensuring that a reduction in the internal diameter of the adapter sleeve 10 takes place over a larger area.

LIST OF REFERENCE SIGNS

1 first gas distribution system
2 second gas distribution system
3 deformable base sleeve
4 intermediate layer
5 top layer
6 gas inlet
7 first gas outlet
8 gas control unit
9 second gas outlet
10 adapter sleeve
11 third gas distribution system
12 optional cavity
13 gas connection
20 channel
22 channel in the longitudinal direction
24 connecting channel
26 hollowed-out region
30 outer lateral surface
32 inner lateral surface

The invention claimed is:

1. An adapter sleeve (10) for adapting the internal diameter of cylindrical hollow cylinders to the external diameter of a cylindrical roller (100), comprising a sleeve body with (as viewed from the inside to the outside) a deformable base sleeve (3), optionally at least one intermediate layer (4), and a top layer (5), wherein the adapter sleeve has at least one first gas inlet (6), which is connected to a first gas distribution system (1), and wherein the adapter sleeve (10) has at least one first gas outlet (7), which is connected to the first gas distribution system (1) and opens on an outer lateral surface (30) of the adapter sleeve (10), characterized in that the adapter sleeve (10) furthermore comprises a second gas distribution system (2), wherein the second gas distribution system (2) is connected to the gas inlet (6), and the second gas distribution system (2) has a cavity (12), which is designed, when supplied with a pressurized gas, to transmit pressure from the inside to the deformable base sleeve (3) in such a way that the internal diameter of the sleeve body is reduced, at least in a partial region of the adapter sleeve (10), by a deformation of the base sleeve (3).

2. The adapter sleeve (10) as claimed in claim 1, characterized in that a gas connection (13) is arranged as a gas inlet (6) at one end of the adapter sleeve (10).

3. The adapter sleeve (10) as claimed in claim 2, characterized in that the adapter sleeve (10) comprises a third gas distribution system (11), which is connected to the gas inlet (6), and the adapter sleeve (10) furthermore has at least one second gas outlet (9), which is connected to the third gas distribution system (11) and opens on an inner lateral surface (32) of the adapter sleeve (10) on the surface of the deformable base sleeve (3).

4. The adapter sleeve (10) as claimed in claim 3, characterized in that the adapter sleeve (10) comprises a gas control unit (8), which is designed to enable and/or to block the flow of gas from the gas inlet (6) to the first gas distribution system (1), to the second gas distribution system (2) and/or to the third gas distribution system (11).

5. The adapter sleeve (10) as claimed in claim 4, characterized in that the gas control unit (8) is selected from the group comprising a two-way cock, a three-way cock, at least one switch, at least one valve, a banjo bolt and combinations of at least two of these units.

6. The adapter sleeve (10) as claimed in claim 3, characterized in that the at least one first gas outlet (7) and/or the at least one second gas outlet (9) are/is designed to discharge compressed air in a manner distributed over the length of the adapter sleeve (10) or adjacent to one end of the adapter sleeve (10).

7. The adapter sleeve (10) as claimed in claim 3, characterized in that the at least one first gas outlet (7) and/or the at least one second gas outlet (9) are/is embodied as circumferentially arranged holes or circumferentially arranged porous regions.

8. The adapter sleeve (10) as claimed in claim 1, characterized in that the at least one gas inlet (6) is arranged on the inner side of the sleeve body and is designed for connection to gas outlets on the outer lateral surface of the cylindrical roller.

9. The adapter sleeve (10) as claimed in claim 1, characterized in that the cavity (12) extends substantially over the length of the adapter sleeve (10) or is limited to a region adjoining one of the ends.

10. An arrangement containing a cylindrical roller (100) and at least one adapter sleeve (10) as claimed in claim 1 mounted on the roller.

11. An arrangement containing a cylindrical roller (100), at least one adapter sleeve (10) as claimed in claim 1 mounted on the roller and at least one hollow cylinder (200) mounted on the adapter sleeve (10).

12. A method for mounting a hollow cylinder on a cylindrical roller (100) using the adapter sleeve (10) as claimed in claim 1, comprising the following steps:

a) supplying a cylindrical roller (100), supplying the adapter sleeve (10) and supplying a hollow cylinder (200), b) positioning the adapter sleeve (10) on the cylindrical roller (100), c) supplying the adapter sleeve (10) with a pressurized gas in such a way that the gas enters the cavity (12) in the adapter sleeve (10), wherein the gas in the cavity (12) transmits pressure to the deformable base sleeve (3) of the adapter sleeve (10) in such a way that the internal diameter of the adapter sleeve (10) is reduced, at least in a partial region of the adapter sleeve (10), by a deformation of the base sleeve (3) and thereby clamps the adapter sleeve (10) on the cylindrical roller, d) supplying the adapter sleeve (10) with a pressurized gas in such a way that the gas flows out via the first gas distribution system (1) of the adapter sleeve (10), via at least one first gas outlet (7) at the outer lateral surface of the adapter sleeve (10), and forms a gas cushion, e) mounting and positioning the hollow cylinder (200) on the adapter sleeve (10), f) switching off the gas supply, wherein an excess pressure in the cavity (12) in the adapter sleeve (10) may optionally be maintained.

13. The method as claimed in claim 12, characterized in that the cylindrical roller (100) is equipped with a gas distribution system, with the result that the cylindrical roller (100) supplies a gas cushion for the positioning of the adapter sleeve (10) on the cylindrical roller (100) and, after the positioning of the adapter sleeve (10) on the cylindrical roller, the gas for acting upon the adapter sleeve (10) is supplied through the cylindrical roller (100).

14. The method as claimed in claim 12, characterized in that, to mount the adapter sleeve (10) on the cylindrical roller (100), the adapter sleeve (10) is supplied with a gas via a gas connection (13) of the adapter sleeve (10) in such a way that the gas emerges from at least one second gas outlet (9), which opens at an inner lateral surface of the adapter sleeve (10) and forms a gas cushion which enables the adapter sleeve (10) to be mounted on or demounted from the cylindrical roller (100).

15. A method for demounting a hollow cylinder (200) from a cylindrical roller (100) which has been mounted using the adapter sleeve (10) according to claim 1, comprising the following steps:

a) supplying an arrangement containing a roller (100) equipped with a gas supply, the adapter sleeve (10), and at least one hollow cylinder (200), b) supplying the adapter sleeve (10) with a pressurized gas in such a way that the gas enters the cavity (12) in the adapter sleeve (10), wherein the gas in the cavity (12) transmits pressure to the deformable base sleeve (3) of the adapter sleeve (10) in such a way that the internal diameter of the adapter sleeve (10) is reduced, at least in a partial region of the adapter sleeve (10), by a deformation of the base sleeve (3) and thereby clamps the adapter sleeve (10) on the cylindrical roller (100), c) supplying the adapter sleeve (10) with a gas, with the result that the gas flows out via the first gas distribution system (1) of the adapter sleeve (10) and via at least one first gas outlet (7) at the outer lateral surface of the adapter sleeve (10), and forms a gas cushion, d) removing the hollow cylinder (200).

* * * * *